US005533909A

United States Patent [19]

Endo et al.

[11] Patent Number: 5,533,909

[45] Date of Patent: Jul. 9, 1996

[54] SCREW CLAMP TYPE CONNECTOR WITH TERMINAL PROTECTING PLATE

[75] Inventors: Takayoshi Endo; Sakai Yagi; Toru Nagano, all of Shizuoka, Japan

[73] Assignee: Yazaki Corporation, Tokyo, Japan

[21] Appl. No.: 398,508

[22] Filed: Mar. 3, 1995

[30] Foreign Application Priority Data

Mar. 8, 1994 [JP] Japan ..... 6-037208

[51] Int. Cl.[6] ..... H01R 13/621

[52] U.S. Cl. ..... 439/381; 439/488; 439/489

[58] Field of Search ..... 439/381, 488, 439/489, 362, 364

[56] References Cited

U.S. PATENT DOCUMENTS

| | | | |
|---|---|---|---|
| 4,804,341 | 2/1989 | Kato et al. | 439/733 |
| 5,100,336 | 3/1992 | Burgess et al. | 439/364 |
| 5,203,718 | 4/1993 | Chishima | 439/489 |
| 5,228,867 | 7/1993 | Nagamine | 439/489 |

FOREIGN PATENT DOCUMENTS

| | | | |
|---|---|---|---|
| 64-7777 | 1/1989 | Japan | H01R 13/64 |
| 587848 | 11/1993 | Japan | H01R 13/639 |

*Primary Examiner*—David L. Pirlot
*Assistant Examiner*—T. C. Patel
*Attorney, Agent, or Firm*—Sughrue, Mion, Zinn, Macpeak & Seas

[57] ABSTRACT

A screw clamp type connector includes a first connector housing into which male terminals fit, a terminal protecting plate which is fitted into the first connector housing, a second connector housing into which female terminals fit and which is equipped with a locknut, and a simple clamp bolt. The terminal protecting plate is provided with a plane section having terminal support holes each corresponding in position to the terminal receiving holes of the first connector housing, and a pair of housing indicators each erected upright on both end sides of the underside of the plane section. An opening is formed in the central part of the plane section so as to receive the bolt holder formed in the central front part of the first connector housing.

14 Claims, 10 Drawing Sheets

SCREW CLAMP TYPE CONNECTOR WITH TERMINAL PROTECTING PLATE

BACKGROUND OF THE INVENTION

The present invention relates to screw clamp type multipolar connectors for use in automobile wiring harness and the like, and more particularly to a screw clamp type connector with a terminal protecting plate which protects connection terminals and is fitted into a connector housing.

As the versatility of electronic equipment increases, the recent trend is for multipolar connectors to be employed very often for wiring harness in the automotive industry and like. For example, there is a known screw clamp type connector having a pair of male and female connector housings into which male and female terminals respectively fit and a simple clamp bolt screwed into one of the connector housings, so that both the connector housings are uniformly mated together by tightening the clamp bolt.

As shown in FIG. 16, a conventional female connector housing 81 is provided with a bolt holder 82 projecting on the terminal insertion hole side and a simple clamp bolt 83 is screwed into the bolt holder 82. A male connector housing 80, on the other hand, is equipped with a nut 80A secured to the central part of the front edge face on its mating side so as to anchor the clamp bolt 83 passed through the female connector housing 81. When the clamp bolt 83 is thus anchored, both the connector housings 80 and 81 are mated together.

However, the bolt holder projected from the rear end side of the female connector housing 81 under the conventional arrangement above may interfere with the work of inserting the male terminals; consequently, it has proved a hindrance to automating the step of fitting connecting terminals into a terminal receiving chamber in such a connector housing.

Moreover, there is a possibility that the leading ends of male terminals to be fitted into the female connector housing may be bent for some reason before being fitted into the female connector or during the time of mating work against the counterpart connector housing.

In a case where the leading end of the male terminal fitted into a female connector housing remains slightly curved, further, the leading end thereof may not fit close to the proper position of a corresponding female terminal in the course of coupling the female connector housing to the opposite connector housing 80. For example, the leading end of such a male terminal that has been bent may be forced in between the female terminal in the opposite connector housing and the wall surface thereof.

As a result, male and female terminals to be coupled together may be collapsed and deformed. If this process of fitting female and male terminals together is continued, there will arise a problem in that connectors may be mated together in such abnormal conditions. Moreover, there still remains a reasonable fear that the abnormal conditions may become difficult to detect during the step of inspection because even though abnormalities such as the deformation and collapse of male and female terminals exist, conductivity is established therebetween temporarily and casually.

SUMMARY OF THE INVENTION

The present invention has been made to solve the foregoing problems and an object of the present invention is to provide a screw clamp type connector with a terminal protecting plate, which is designed to prevent connecting terminals from bending, to make any abnormal conditions of connecting terminals easily detectable, and to enable easy confirmation of mating conditions of connector housings.

According to a first aspect of the present invention, a screw clamp type connector with a terminal protecting plate comprises a first connector housing into which not only male terminals but also the terminal protecting plate for protecting the leading ends of the male terminals fits, a second connector housing into which female terminals fit, and a simple clamp bolt passed through the centers of the first and second connector housings so as to mate the first and second connector housings together by clamping, wherein a pair of housing indicators are erected upright on the underside of the terminal protecting plate having terminal support holes bored, through the plane section of the terminal protecting plate in such a manner as to make the terminal support holes correspond in position to the leading ends of the respective male terminals fitted into the first connector housing, the housing indicators being caused to stick out of respective housing indicator holes bored in the first connector housing when both the connector housings are mated together.

According to a second aspect of the present invention, a screw clamp type connector with a terminal protecting plate comprises a first connector housing into which not only male terminals but also the terminal protecting plate for protecting the leading ends of the male terminals fits, a cover overlaid from the rear side of the first connector housing, a second connector housing into which female terminals fit, and a simple clamp bolt passed through the centers of the first and second connector housings so as to mate the first and second connector housings together by clamping, wherein a pair of housing indicators are erected upright on the underside of the terminal protecting plate having terminal support holes bored through the plane section of the terminal protecting plate in such a manner as to make the terminal support holes correspond in position to the leading ends of the respective male terminals fitted into the first connector housing, the housing indicators being caused to stick out of respective housing indicator holes bored in the first connector housing when both the connector housings are mated together, and wherein sheaths each having cover indicator holes bored at the leading ends thereof are provided on the inner wall of the cover opposite to the respective housing indicator holes, the sheaths each containing cover indicators.

According to a third aspect of the present invention, a screw clamp type connector with a terminal protecting plate comprises a first connector housing into which not only male terminals but also the terminal protecting plate for protecting the leading ends of the male terminals fits, a cover overlaid from the rear side of the first connector housing, a second connector housing into which female terminals fit, and a simple clamp bolt passed through the centers of the first and second connector housings so as to mate the first and second connector housings together by clamping, wherein a pair of housing indicators are erected upright on the underside of the terminal protecting plate having terminal support holes bored through the plane section of the terminal protecting plate in such a manner as to make the terminal support holes correspond in position to the leading ends of the respective male terminals fitted into the first connector housing, the housing indicators being caused to stick out of respective housing indicator holes bored in the first connector housing when both the connector housings are mated together, the housing indicators being substantially long enough to stick out of respective cover indicator holes when the cover whose indicator guides each having the cover indicator holes are provided, opposite to the respective housing indicator holes, on the inner wall of the cover, is overlaid on the first connector housing.

In the screw clamp type connector with a terminal protecting plate according to the first aspect of the present invention, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted into the first connector housing, and the housing indicators are caused to stick out of the respective housing indicator holes bored in the first connector housing when both the connector housings are mated together.

The terminal protecting plate is temporarily retained in the first connector housing into which the male terminals fit before the first connector housing is mated with the second connector housing. When the male terminals are fitted into the terminal receiving chamber from the rear side of the housing, the leading ends of the male terminals are passed through and supported with the respective terminal support holes formed in the terminal protecting plate. Any faulty terminal can thus be detected before the first connector housing is mated with the second connector housing because the faulty terminal having a curved leading end is not allowed to pass through the terminal support hole.

When the clamp bolt is tightened subsequently, the second connector housing is moved and set closer to the first connector housing. Then the terminal protecting plate abuts against the front edge face of the second connector housing and the leading ends of the male terminals supported with the terminal support holes come in contact with the corresponding female terminals received in the second connector housing, whereby the leading ends of the male terminals are prevented from being bent and deformed during the work of mating both the connector housings together.

When both the connector housings are properly mated together as the clamp bolt is tightened, the leading ends of the pair of housing indicators erected upright on the underside of the plane section of the terminal protecting plate stick out of the respective housing indicator holes bored in the rear edge face of the first connector housing. By visually observing the leading ends of the housing indicators thus sticking out of the holes, it is made confirmable whether both the connector housings have properly been mated together.

In the screw clamp type connector with a terminal protecting plate according to the second aspect the present invention, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted into the first connector housing, the housing indicators being caused to stick out of the respective housing indicator holes bored in the first connector housing when both the connector housings are mated together, and further the sheaths each having the cover indicator holes bored at the leading ends thereof are provided on the inner wall of the cover opposite to the respective housing indicator holes, the sheaths each containing the cover indicators.

The terminal protecting plate is temporarily retained in the first connector housing in which the male terminals fit before the first connector housing is mated with the second connector housing. Any faulty terminal can be detected before the connector housing is mated with the second connector housing and thereby, as set forth above, and the leading ends of the male terminals are prevented from being bent and deformed during the work of mating both the connector housings together.

When both the connector housings are properly mated together as the clamp bolt is tightened, the pair of housing indicators erected upright on the underside of the plane section of the terminal protecting plate also move. Therefore, the leading ends of the housing indicators push the upper ends of the respective cover indicators when both the connector housings and the cover are fitted together, whereby the leading ends of the cover indicators stick out of the respective cover indicator holes. The cover indicators thus sticking out make it confirmable whether both the connector housings have properly been mated together.

In the screw clamp type connector with a terminal protecting plate according to the third aspect of the present invention, further, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted into the first connector housing, the housing indicators being caused to stick out of the respective housing indicator holes bored in the first connector housing when both the connector housings are mated together, the housing indicators being substantially long enough to stick out of respective cover indicator holes when the cover whose indicator guides each having the cover indicator holes are provided, opposite to the respective housing indicator holes, on the inner wall of the cover, is overlaid on the first connector housing.

The terminal protecting plate is temporarily retained in the first connector housing in which male terminals fit before the first connector housing is mated with the second connector housing. Any faulty terminal can be detected before the connector housing is mated with the second connector housing and thereby, as set forth above, the leading ends of the male terminals are prevented from being bent and deformed during the work of mating both the connector housings together.

When both the connector housings are properly mated together as the clamp bolt is tightened, the pair of housing indicators erected upright on the underside of the plane section of the terminal protecting plate also move. Therefore, the leading ends of the long housing indicators are caused to stick out of the respective cover indicator holes when both the connector housings and the cover are fitted together. The housing indicators thus sticking out make it confirmable whether both the connector housings have properly been mated together.

DETAILED DESCRIPTION OF THE PREFERRED EMBODIMENTS

Figure 1:
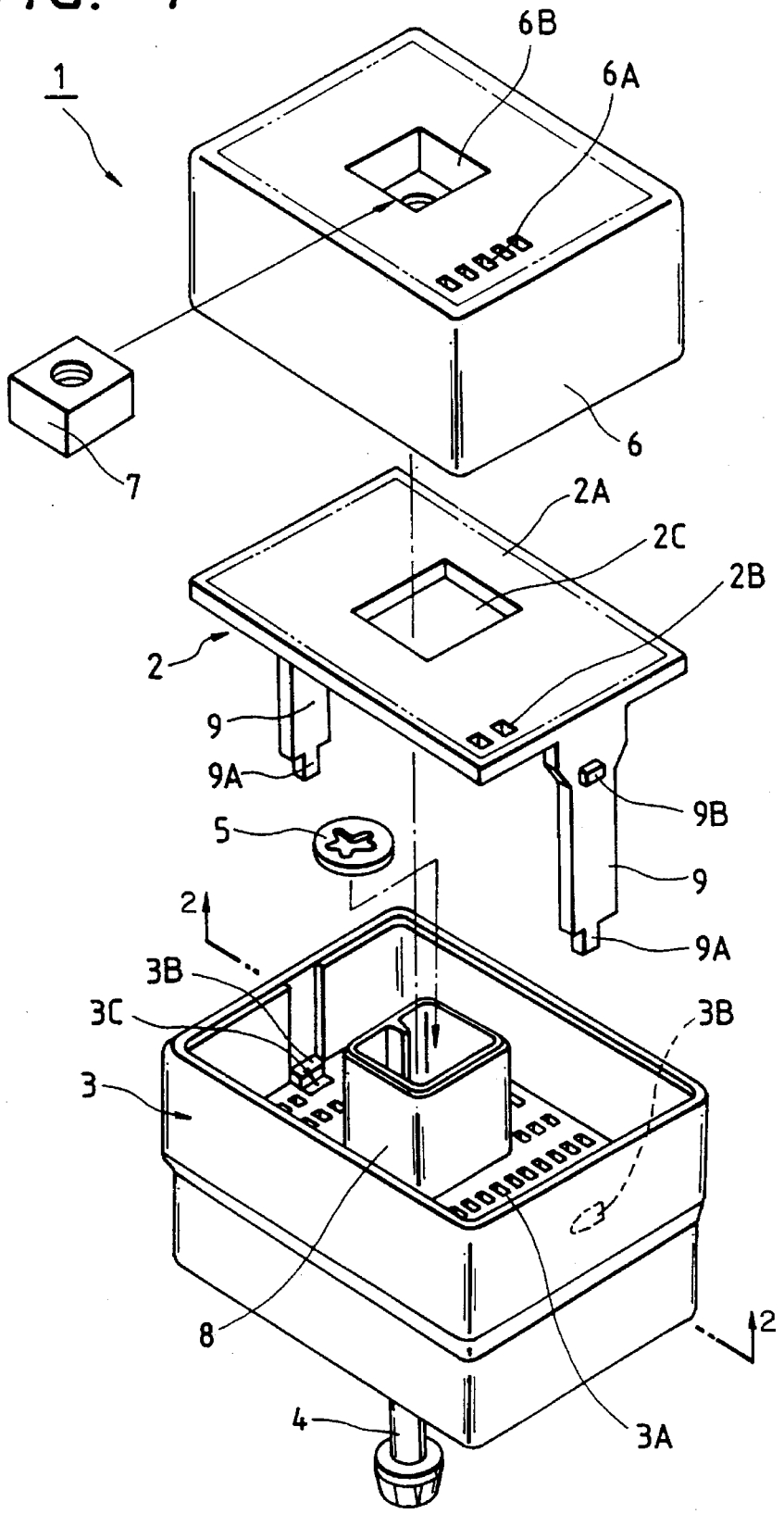
FIG. 1 is an exploded perspective view of a screw clamp type connector with a terminal protecting plate as a first embodiment of the invention.
Figure 2:
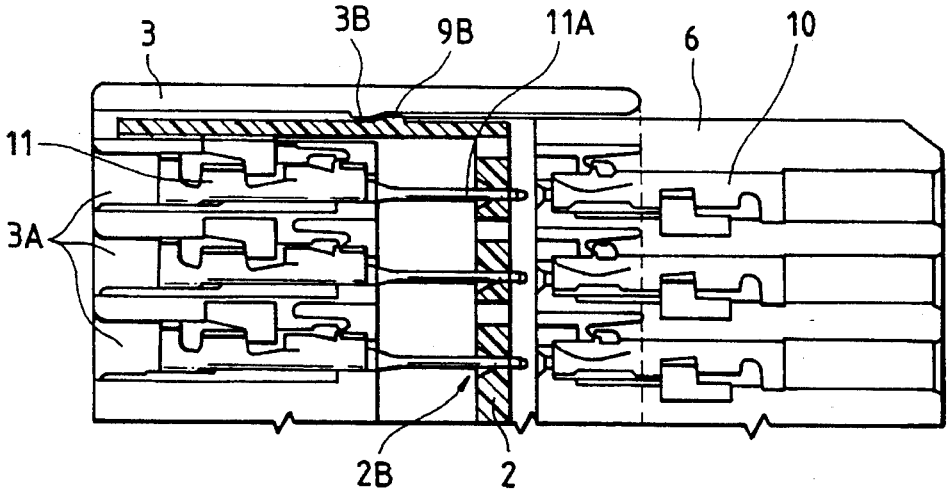
FIG. 2 is an enlarged sectional view of the principal part of the connector taken along line R—R of FIG. 1 before the connector housings are mated together.
Figure 3:
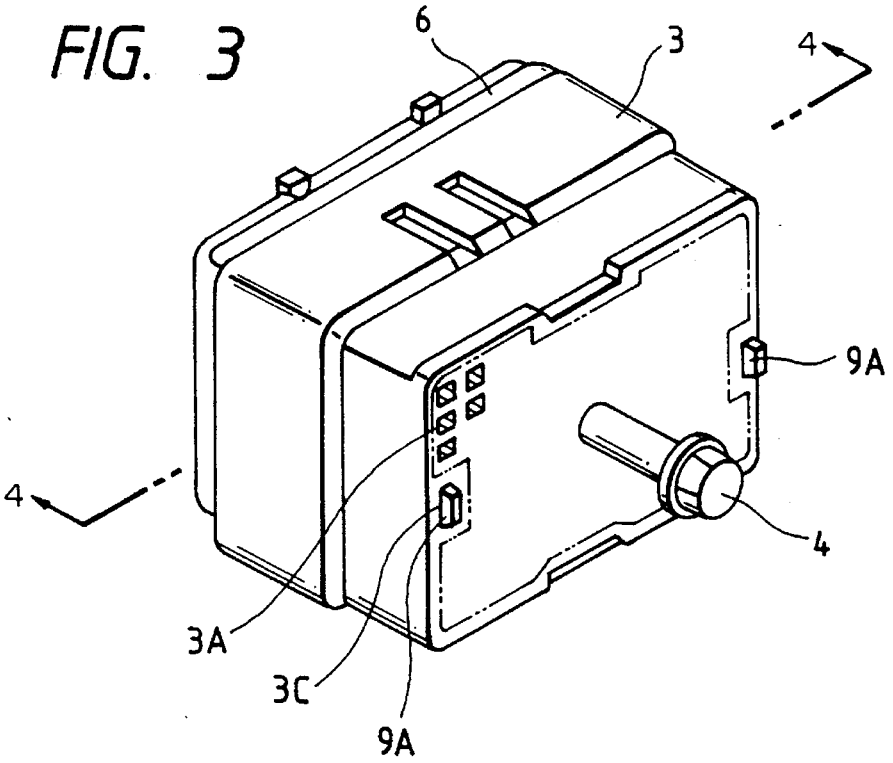
FIG. 3 is a perspective view of the connector of FIG. 1 with the connector housings properly mated together.
Figure 4:
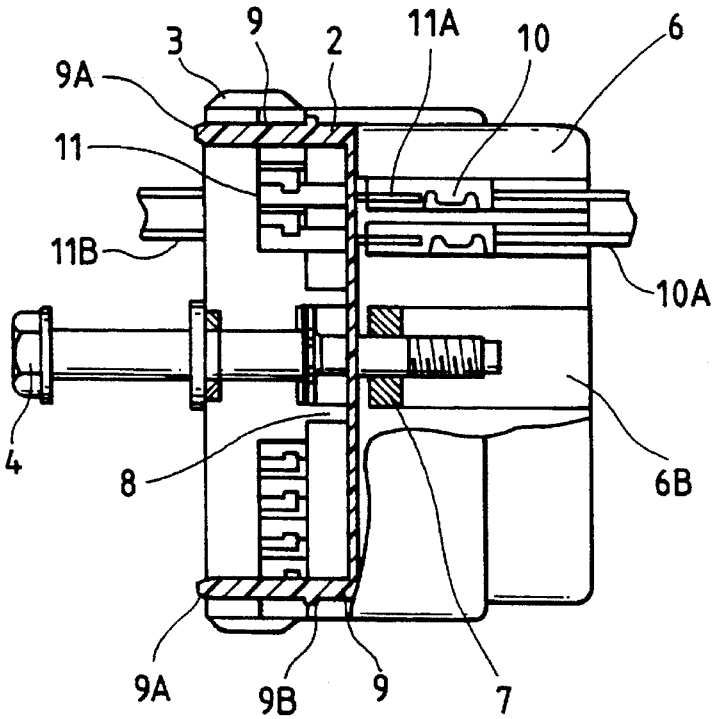
FIG. 4 is a sectional view taken along line S—S of FIG. 3.

Referring to FIGS. 1 through 4, a screw clamp type connector with a terminal protecting plate according to a first embodiment of the present invention will be described. FIG. 1 is an exploded perspective view of a screw clamp type connector with a terminal protecting plate as the first embodiment of the invention; FIG. 2 is an enlarged sectional view of the principal part of the connector taken along line R—R of FIG. 1 before the connector housings are mated together; FIG. 3 is a perspective view of the connector of FIG. 1 with the connector housings properly mated together; and FIG. 4 is a sectional view taken along line S—S of FIG. 3.

As shown in FIG. 1, a screw clamp type connector 1 with a terminal protecting plate as the first embodiment of the invention comprises a first connector housing 3 into which male terminals fit, a terminal protecting plate 2 which is fitted into the first connector housing 3, a second connector housing 6 into which female terminals fit and which is equipped with a locknut 7, and a simple clamp bolt 4. The clamp bolt 4 is screwed via a washer 5 into a bolt holder 8 from the rear end of the first connector housing 3 and passed through the opening 2C of the terminal protecting plate 2 up to the second connector housing 6. Then the clamp bolt 4 is screwed into the locknut 7 secured to a retaining hole 6B bored in the central part of the rear edge face of the second connector housing 6.

The terminal protecting plate 2 is provided with a plane section 2A having terminal support holes 2B each corresponding in position to the terminal receiving holes 3A of the first connector housing 3, and a pair of housing indicators 9, 9 each erected upright on both end sides of the underside of the plane section 2A. The opening 2C is formed in the central part of the plane section 2A so as to receive the bolt holder 8 formed in the central front part of the first connector housing 3.

When the pair of housing indicators 9, 9 are fitted into the first connector housing 3, temporary retaining protrusions 9B, 9B formed on the sides thereof are temporarily retained by the respective temporary retaining members 3B, 3B of the first connector housing 3. More specifically, while the first and second connector housings 3 and 6 are not completely mated together, the temporary retaining protrusions 9B, 9B are retained by the respective temporary retaining members 3B, 3B, so that the terminal protecting plate 2 is temporarily retained in the first connector housing 3.

While the terminal protecting plate 2 is temporarily retained as shown in FIG. 2, the leading end 11A of the male terminal 11 is passed through and supported with the terminal support hole 2B. In case the leading end 11A of the male terminal 11 remains curved then, the leading end 11A of the male terminal 11 will be unable to pass through the terminal support hole 2B and collide with the wall surface of the terminal protecting plate 2. Consequently, any faulty connecting terminal can surely be found and readily removed. Moreover, the protection of the leading end 11A of the male terminal 11 is ensured as it is passed through and supported with the terminal support hole 2B.

The clamp bolt 4 is tightened to switch the temporary fitted condition of the terminal protecting plate 2 to its fit-in condition. The second connector housing 6 is moved toward the terminal protecting plate 2 and then abuts against the terminal protecting plate 2 in due time. As the second connector housing 6 is moved toward the first connector housing 3 further, the terminal protecting plate 2 is pushed to move toward the first connector housing 3 so that it is completely fitted into the first connector housing 3 from the temporary fit-up condition.

At this time, the terminal protecting plate 2 slides along the leading ends 11A of the male terminals 11 passed through the respective terminal support holes 2B, and moves in the direction in which the male terminals 11 have been fitted in. Therefore, the leading ends 11A of the male terminals are prevented from being bent and deformed during the work of mating both the connector housings 3 and 6 together. The leading ends 11A of the male terminals are thus smoothly moved and coupled to the respective female terminals 10 fitted in the second connector housing 6.

When both the connector housings 3 and 6 are properly mated together as shown in FIGS. 3 and 4, the leading ends 9A, 9A of the pair of housing indicators 9, 9 stick out of respective housing indicator holes 3C bored in the rear edge face of the first connector housing 3. By visually observing the leading ends of the housing indicators 9, 9 thus sticking out of the housing indicator holes 3C, it is made confirmable whether both the connector housings 3, 6 have properly been mated together.

Since the pair of housing indicators 9, 9 are each erected upright on both side ends of the underside of the plane section of the terminal protecting plate 2 in the first embodiment of the invention, the tilted condition of the connector housing is particularly effectively made detectable when both the connector housings are mated together.

Since the housing indicators 9, 9 and the plane section 2A are integrally formed, moreover, the terminal protecting plate 2 is made movable with stability and this facilitates the handling of the terminal protecting plate 2.

Since the housing indicators 9, 9 are provided with the respective temporary retaining protrusions 9B, further, the temporary retaining operation is facilitated and besides a stable temporary retaining condition is maintained.

Figure 6:
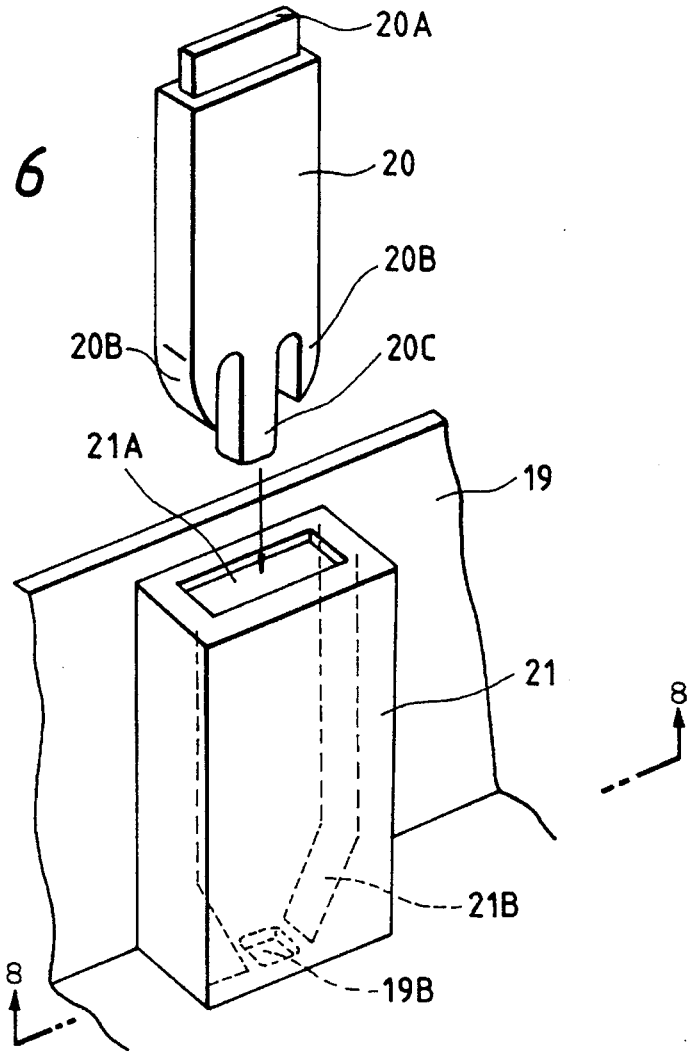
FIG. 6 is an exploded perspective view of the cover indicator portion of FIG. 5.
Figure 5:
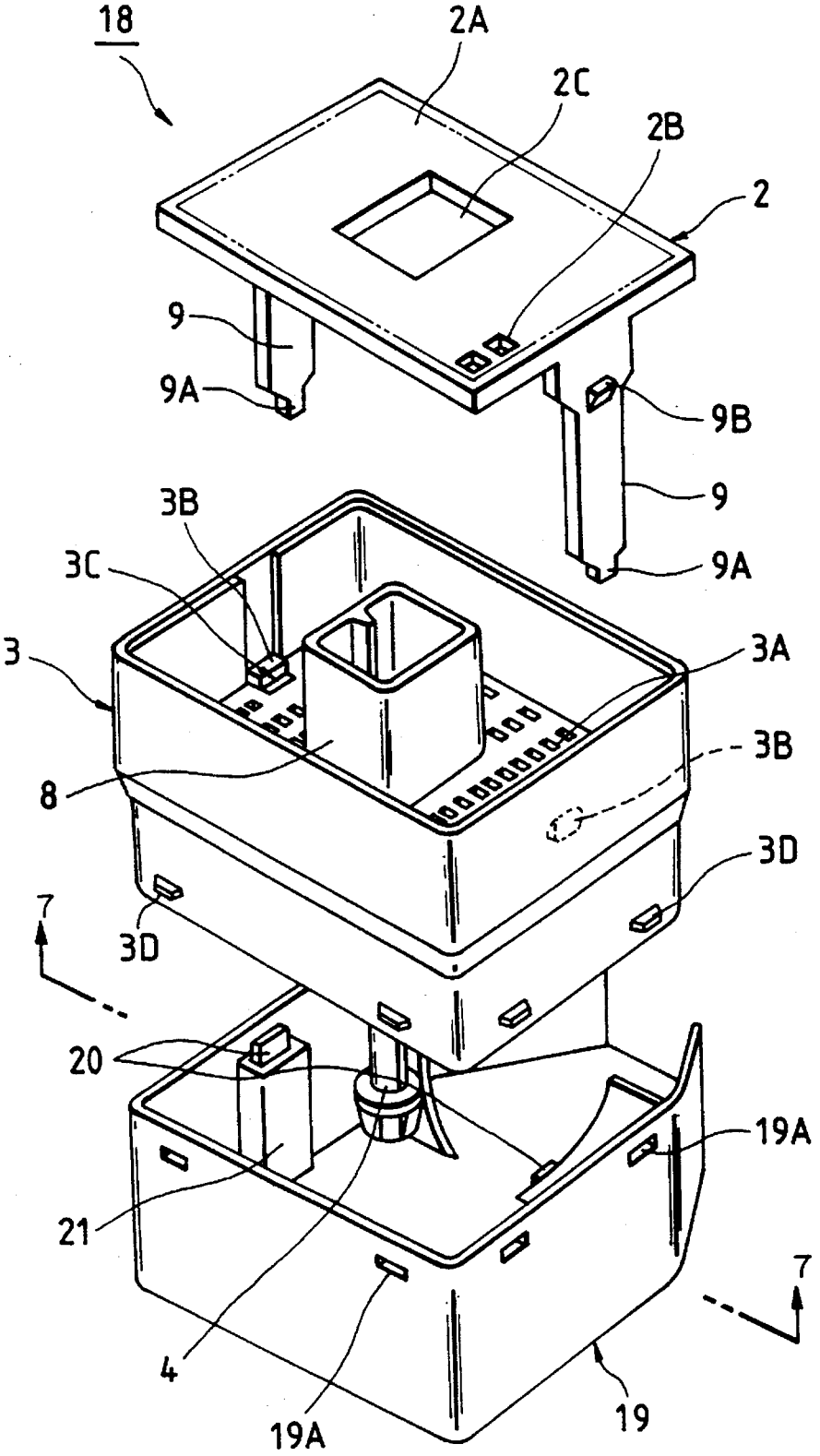
FIG. 5 is an exploded perspective view of a screw clamp type connector with a terminal protecting plate as a second embodiment of the invention.
Figure 7:
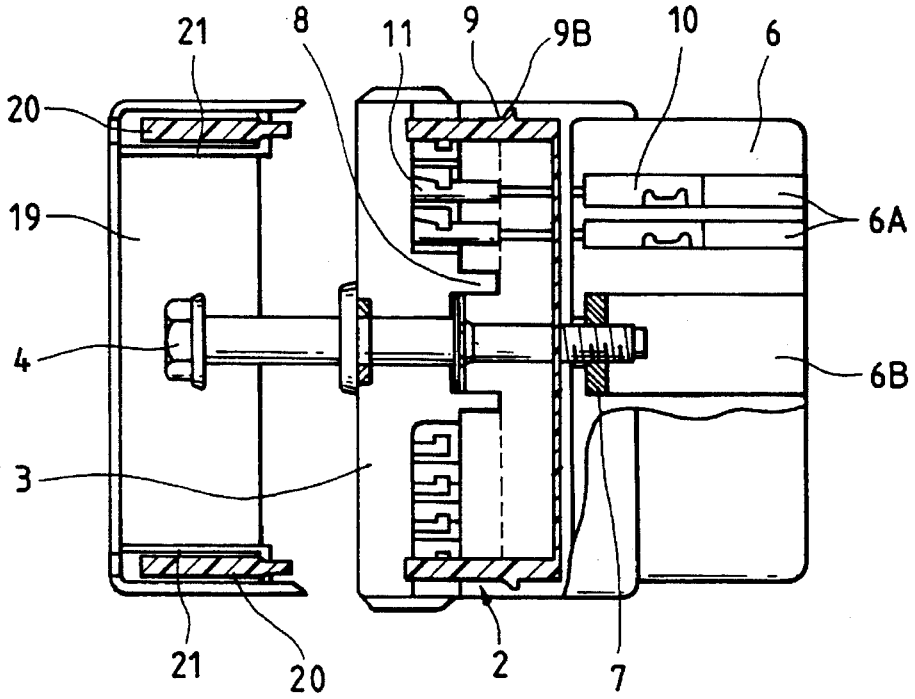
FIG. 7 is a sectional view taken along line T—T of FIG. 5 before the cover is overlaid.
Figure 8:
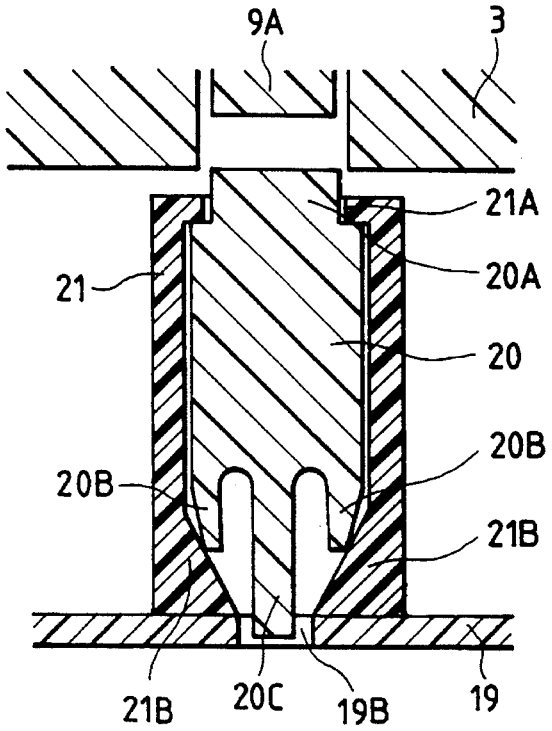
FIG. 8 is a sectional view taken along line U—U of FIG. 6.
Figure 9:
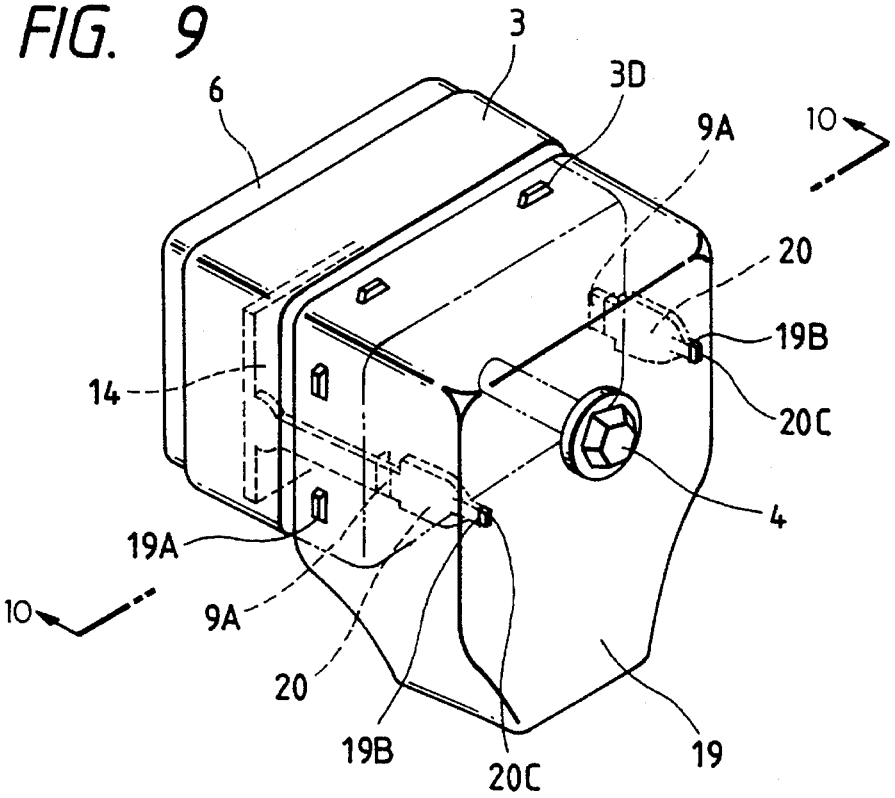
FIG. 9 is a perspective view of the cover properly overlaid in FIG. 6.
Figure 10:
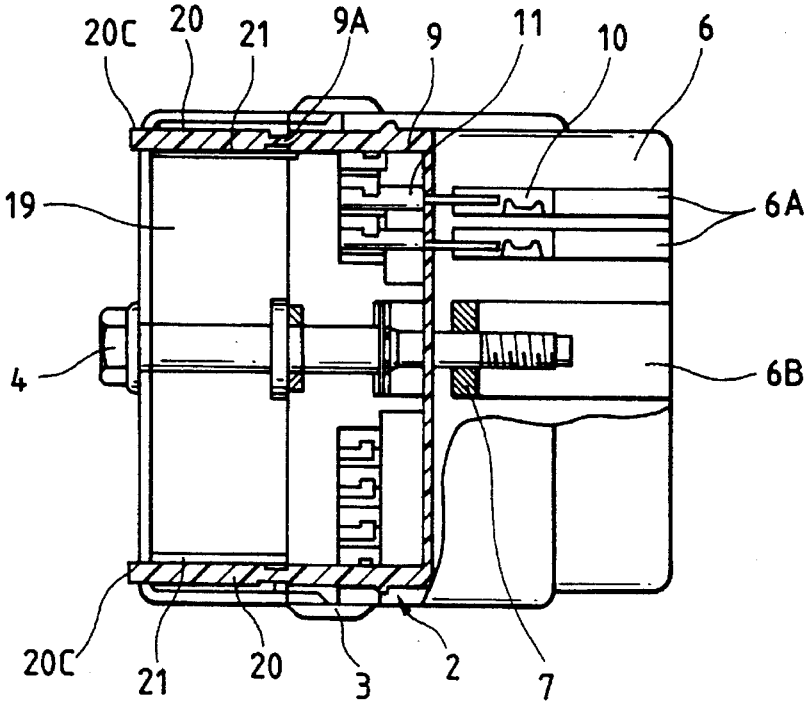
FIG. 10 is a sectional view taken along line X—X of FIG. 9.
Figure 11:
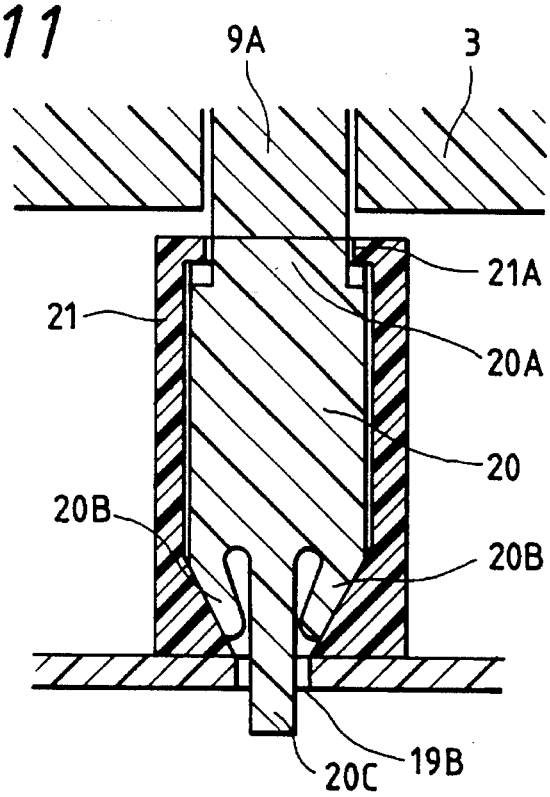
FIG. 11 is a sectional view of the cover indicator portion of FIG. 9.

Referring to FIGS. 5 through 11, a screw clamp type connector with a terminal protecting plate according to a second embodiment of the present invention will be described. FIG. 5 is an exploded perspective view of a screw clamp type connector with a terminal protecting plate as the second embodiment of the invention; FIG. 6 is an exploded perspective view of the cover indicator portion of FIG. 5; FIG. 7 is a sectional view taken along line T—T of FIG. 5 before the cover is overlaid; FIG. 8 is a sectional view taken along line U—U of FIG. 6; FIG. 9 is a perspective view of the cover properly overlaid; FIG. 10 is a sectional view taken along line X—X of FIG. 9; and FIG. 11 is a sectional view of the cover indicator portion of FIG. 9.

As shown in FIG. 5, a screw clamp type connector 18 comprises a first connector housing 3 into which male terminals fit, a cover 19 overlaid from the rear side of the first connector housing 3, a terminal protecting plate 2 fitted from the front side of the first connector housing 3, a second connector housing 6 (see FIG. 7) into which female terminals fit, and a simple clamp bolt 4 for mating both the connector housings 3 and 6.

The clamp bolt 4 is screwed in from the cover side 19, passed through the bolt holder 8 formed in the central front part of the first connector housing 3 into which the male terminals 11 fit and securely screwed via the opening 2C of the terminal protecting plate 2 into the nut 7 provided in the retaining hole bored in the central part of the second connector housing 6 (not shown, see FIG. 1). In other words, the pair of connector housings 3 and 6 are mated together at a single stroke when the clamp bolt 4 is tightened. Hereinafter, a description of constitutional elements common to those in the first embodiment above will be omitted.

As shown in FIG. 6, a sheath 21 containing a cover indicator 20 is provided on the inner wall of the cover 19 in a position corresponding to the housing indicator 9. A slightly narrow upper end portion 20A is formed at the upper end of the cover indicator 20, whereas a narrower projection 20C is formed at the lower end thereof. Further, a flexible piece 20B is formed on both sides of the projection 20C with a space therebetween. This cover indicator 20 is inserted into the sheath 21 via an indicator insertion opening 21A formed at the upper end of the sheath 21.

The sheath 21 is provided with the indicator insertion opening 21A at the upper end and a cover indicator hole 19B for letting only the projection 20C of the cover indicator 20 pass therethrough at the lower end thereof. Further, the sheath 21 is provided with slopes 21B, 21B in a position where the flexible pieces 20B, 20B of the cover indicator 20 come in contact with the former.

As shown in FIG. 7, the male terminals 11 are first fitted into the first connector housing 3. Subsequently, both the first connector housing 3 with the terminal protecting plate 2 temporarily retained and the second connector housing 6 fitted with the female terminals 10 are moved in the mating direction as the clamp bolt 4 is tightened. Then the cover 19 is overlaid in that condition.

As shown in FIG. 8, the upper end portion 20A of the cover indicator 20 remains to have protruded from the upper end of the sheath 21 of the cover 19 with the terminal protecting plate 2 temporarily retained, whereas the leading end 9A of the housing indicator 9 on the first connector housing side 3 has been contained in the first connector housing 3. Thus the cover indicator 20 and the housing indicator 9 are not in contact with each other in this phase. Consequently, the flexible pieces 20B, 20B of the cover indicator 20 are held in a natural form and the projection 20C at the fore-end of the cover indicator 20 is contained in the sheath 21.

While the terminal protecting plate 2 is temporarily retained in the first connector housing 3, it abuts against the front edge face of the second connector housing 6 when the clamp bolt 4 is tightened as in the case of the first embodiment and moves in the first connector housing 3 in the direction in which the male terminals 11 are fitted. When both the connector housings are properly mated together, the leading ends 9A, 9A of the housing indicators 9, 9 of the terminal protecting plate 2 stick out from the rear edge face of the first connector housing 3.

As shown in FIGS. 9 and 10, the cover 19 is overlaid from the rear end of the first connector housing 3, and retaining holes 19A formed in the peripheral wall of the cover 19 are retained by respective cover retaining protrusions 3D formed on the outer peripheral wall of the first connector housing 3. When the clamp bolt 4 is further screwed in from the outside of the cover 19, the first connector housing 3 and the second connector housing 6 are completely mated together.

As shown in FIG. 11, the leading ends 9A, 9A of the housing indicators 9, 9 of the terminal protecting plate 2 stick out from the rear edge face of the first connector housing 3 and push the upper end portions 20A of the respective cover indicators 20. The displacement of the flexible pieces 20B, 20B of the cover indicator 20 then takes place because of the pressure thus applied and the cover indicator 20 is caused to move down in the sheath 21. Ultimately, the projection 20C sticks out of the cover indicator hole 19B at the lower end of the sheath 21. In other words, the projections 20C at the fore-ends of the cover indicators 20 stick out of the respective cover indicator holes 19B of the cover 19 when both the connector housings 3, 6 are properly mated together. The present condition of the connector housings with the cover overlaid thereon can readily be confirmed.

Figure 13:
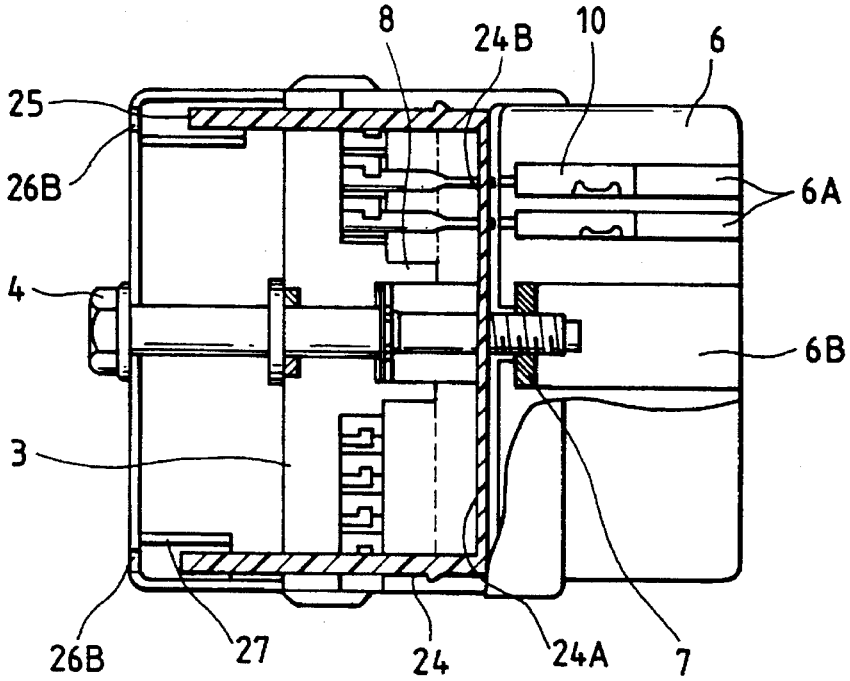
FIG. 13 is a sectional view taken along line Y—Y of FIG. 12 illustrating the terminal protecting plate temporarily retained.
Figure 12:
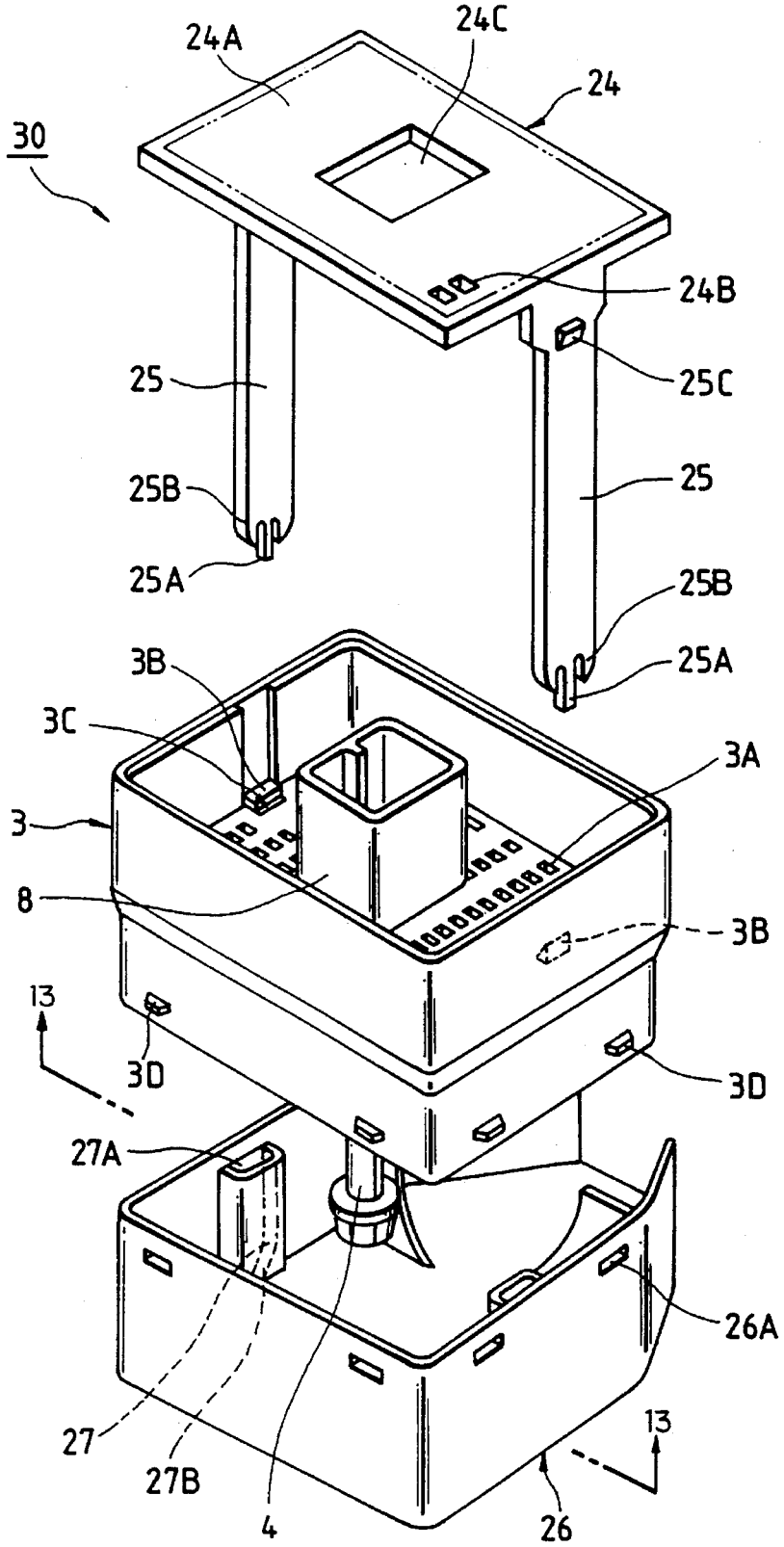
FIG. 12 is an exploded perspective view of a screw clamp type connector with a terminal protecting plate as a third embodiment of the invention.
Figure 14:
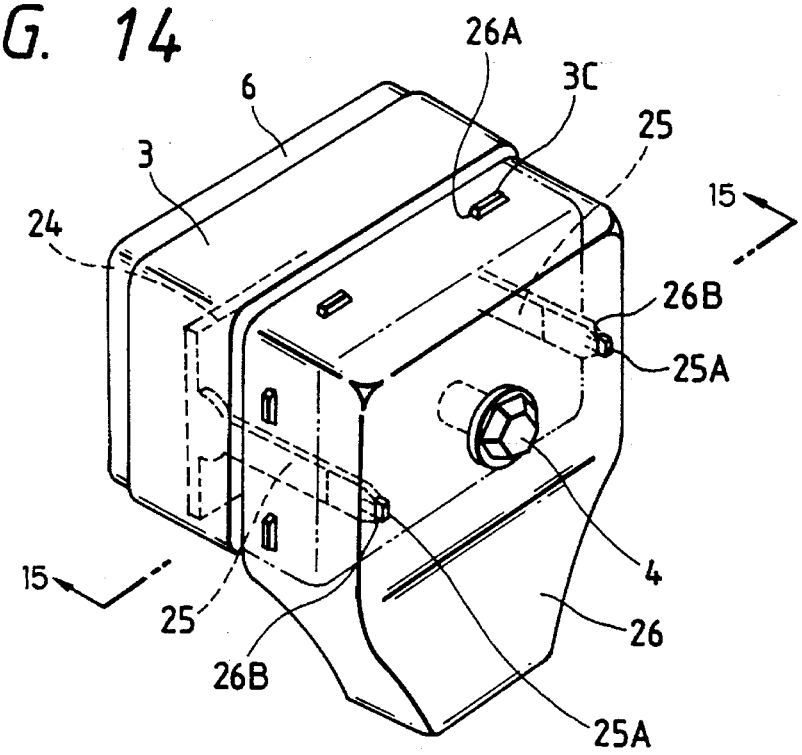
FIG. 14 is a sectional view of connectors in FIG. 12 properly mated together.
Figure 15:
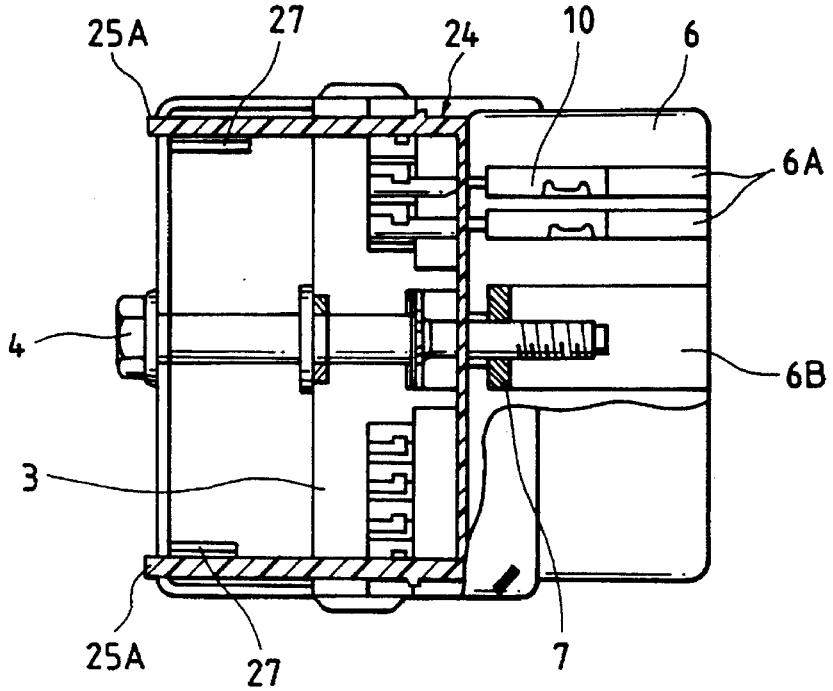
FIG. 15 is a sectional view taken along line Z—Z of FIG. 14.
Figure 16:
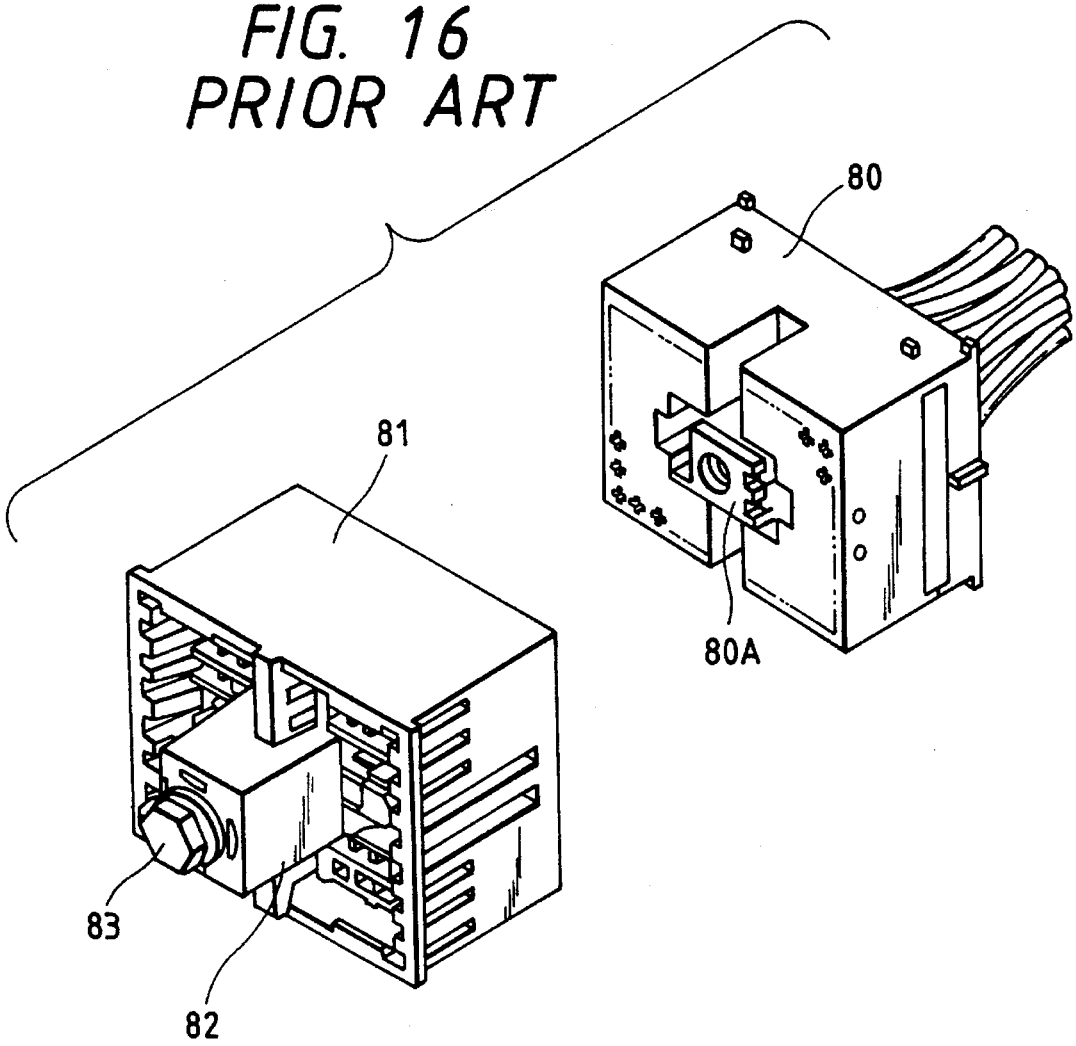
FIG. 16 PRIOR ART
FIG. 16 is a perspective view of a conventional screw clamp type connector.

Referring to FIGS. 12 through 15, a screw clamp type connector with a terminal protecting plate according to a third embodiment of the present invention will be described. FIG. 12 is an exploded perspective view of a screw clamp type connector with a terminal protecting plate as the third embodiment of the invention; FIG. 13 is a sectional view taken along line Y—Y of FIG. 12 illustrating the terminal protecting plate temporarily retained; FIG. 14 is a sectional view of connectors properly mated together; and FIG. 15 is a sectional view taken along line Z—Z of FIG. 14.

As shown in FIG. 12, a screw clamp type connector 30 as the third embodiment of the invention comprises a first connector housing 3 into which male terminals fit, a cover 26 overlaid from the rear side of the first connector housing 3, a terminal protecting plate 24 fitted from the front side of the first connector housing 3, a second connector housing 6 (see FIG. 7) into which female terminals fit, and a simple clamp bolt 4 for mating both the connector housings 3 and 6 together.

The clamp bolt 4 is screwed inward from the cover 26 side and passed through the bolt holder 8 formed in the central front part of the first connector housing 3 into which the male terminals 11 fit and securely screwed via the opening 24C of the terminal protecting plate 24 into the nut 7 provided in the retaining hole bored in the central part of the second connector housing 6 (see FIG. 1). In other words, the pair of connector housings 3 and 6 are mated together at a single stroke when the clamp bolt 4 is tightened. Hereinafter, a description of constitutional elements common to those in the first embodiment above will be omitted.

The terminal protecting plate 24 is provided with a plane section 24A having terminal support holes 24B each corresponding in position to the terminal receiving holes 3A of the first connector housing 3, and a pair of housing indicators 25, 25 each erected upright on both end sides of the underside of the plane section 24A. These housing indicators 25, 25 are long enough to stick out from the cover 26 overlaid on the first connector housing 3.

A narrow projection 25A is formed at the fore-end of the housing indicator 25. Further, a flexible piece 25B is also formed on both sides of the projection 25A with a space therebetween.

Indicator guides 27, 27 for guiding the housing indicators 25 are provided on the inner wall of the cover 26. The indicator guide 27 is provided with an indicator insertion hole 27A at the upper end and a cover indicator hole 26B for letting the housing indicator 25 stick out therefrom at the lower end (see FIG. 13). Moreover, tapered slopes 27B are formed inside the lower portion of the indicator guide 27.

While the first and second connector housings 3 and 6 are not completely mated together as shown in FIG. 13, the pair of housing indicators 25, 25 are inserted into the first connector housing 3. At this time, temporary retaining protrusions 25C formed on the sides of the housing indicators 25, 25 engage with the respective temporary retaining members 3B provided in the inner wall of the first connector housing 3, so that terminal protecting plate 24 is temporarily retained in the first connector housing 3.

During the temporary retaining operation above, the terminal protecting plate 24 supports the leading end of the male terminal 11 by passing it through the terminal support hole 24B. When the leading end of the male terminal is bent, it may not pass through the terminal support hole 24B and may consequently collide with the wall surface of the plane section 24A. Abnormal conditions of the terminals are thus made readily confirmable and removable. Moreover, the leading ends of the male terminals 11 can be protected during the work of mating the connector housings together.

In order to mate the connector housings together in the temporarily retained state as shown in FIGS. 14 and 15, the clamp bolt 4 is screwed inward to move the second connector housing 6 and make it abut against the terminal protecting plate 24. When the second connector housing 6 is moved to the first connector housing 3 further, the terminal protecting plate 24 is also pushed to move and completely fitted into the first connector housing 3.

While the terminal protecting plate 24 supports and make slide of the leading ends of the male terminals 11 passed through the respective terminal support holes 24B, it moves in the direction in which the male terminals 11 have been fitted. Therefore, the leading ends of the male terminals 11 are prevented from being bent and deformed during the work of mating both the connector housings 3 and 6 together. The male terminals 11 are thus smoothly coupled to the respective female terminals 10 fitted in the second connector housing 6.

When both the connector housings are properly mated together as stated above, the long housing indicator 25 advances into the indicator guide 27 in the cover 26. Then the displacement of the flexible pieces 25B at the fore-end of the housing indicator 25 occurs when these pieces 25B abut against the slopes 27B inside the lower portion of the indicator guide 27. Consequently, the projection 25A at the fore-end of the housing indicator 25 sticks out of the cover indicator hole 26B. By visually observing the projections 25A, 25A thus sticking out of the holes, it is made confirmable whether both the connector housings 3, 6 and the cover 26 have properly been mated together.

In the screw clamp type connector with a terminal protecting plate according to the present invention as set forth above, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted in the first connector housing, and the housing indicators are caused to stick out of the respective housing indicator holes bored in the first connector housing when both the connector housings are mated together.

Since the leading ends of the male terminals are passed through the respective terminal support holes bored in the plane section of the terminal protecting plate and supported therewith, any faulty male terminal having a curved leading end, for example, can be removed before both the connector housings are mated together.

When, moreover, the connector housing is moved by tightening the clamp bolt to mate with the counterpart, the terminal protecting plate is also caused to move while supporting the leading ends of the male terminals, whereby the leading ends of the male terminals are prevented from being bent and deformed during the work of mating both the connector housings together.

Further, the leading ends of the pair of housing indicators erected upright on the underside of the terminal protecting plate stick out from the rear edge face of the first connector housing on condition that both the connector housing have properly been mated together. By visually observing the projection of the housing indicators, it is made easily confirmable whether both the connector housings have properly been mated together.

Since the terminal protecting plate and the pair of housing indicators are formed integrally like that, the protection of the male terminals and the confirmation of the present condition of both the connector housings thus mated together can be made with efficiency.

With another arrangement, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted into the first connector housing, the housing indicators being caused to stick out of the respective housing indicator holes bored in the first connector housing when both the connector housings are mated together, and further the sheaths each having the cover indicator holes bored at the leading ends thereof are provided opposite to the respective housing indicator holes, the sheaths each containing the cover indicators.

When both the connector housings and the cover are properly fitted together, the leading ends of the housing indicators push the upper ends of the respective cover indicators, whereby the leading ends of the cover indicators stick out from the cover. The cover indicators thus sticking out make it readily confirmable whether both the connector housings and the cover have properly been fitted together.

With still another arrangement, the pair of housing indicators are erected upright on the underside of the terminal protecting plate having the terminal support holes bored through the plane section of the terminal protecting plate in such a manner as to make the terminal support holes correspond in position to the leading ends of the respective male terminals fitted into the first connector housing, the housing indicators being caused to stick out of the respective housing indicator holes bored in the first connector housing when both the connector housings are mated together, the housing indicators being substantially long enough to stick out of respective cover indicator holes when the cover whose indicator guides each having the cover indicator holes are provided, opposite to the respective housing indicator holes, on the inner wall of the cover, is overlaid on the first connector housing.

Therefore, the leading ends of the long housing indicators are caused to stick out from the cover when both the connector housings and the cover are properly fitted together. The housing indicators thus sticking out make it readily confirmable whether both the connector housings and the cover have properly been fitted together with a smaller number of parts.

What is claimed is:

1. A screw clamp type connector with a terminal protecting plate, comprising:

a first connector housing having housing indicator holes;

a male terminal fitted in said first connector housing;

a terminal protecting plate fitted in said first connector housing for protecting a leading end of said male terminal, said terminal protecting plate having terminal support holes bored through a plane section of said terminal protecting plate in such a manner as to make said terminal support holes correspond in position to said leading end of said male terminal;

a second connector housing;

a female terminal fitted in said second connector housing;

a simple clamp bolt passed through centers of said first and second connector housings so as to mate said first and second connector housings together by clamping; and a pair of housing indicators erected upright on an underside of said terminal protecting plate, said housing indicators being caused to stick out of said respective housing indicator holes when both said first and second connector housings are mated together.

2. A screw clamp type connector with a terminal protecting plate as claimed in claim 1, wherein said housing indicators are provided at both side end portions of said underside of said plane section of said terminal protecting plate.

3. A screw clamp type connector with a terminal protecting plate as claimed in claim 1 or 2, wherein said housing indicators and said plane section of said terminal protecting plate are formed integrally.

4. A screw clamp type connector with a terminal protecting plate as claimed in claim 1 or 2, wherein said housing indicators are each fitted with temporary retaining protrusions for use in temporarily retaining said terminal protecting plate in said first connector housing, and wherein temporary retaining members corresponding in position to said respective temporary retaining protrusions are provided on said first connector housing.

5. A screw clamp type connector with a terminal protecting plate, comprising:

a first connector housing having housing indicator holes;

a male terminal fitted in said first connector housing;

a terminal protecting plate fitted in said first connector housing for protecting a leading end of said male terminal, said terminal protecting plate having terminal support holes bored through a plane section of said terminal protecting plate in such a manner as to make said terminal support holes correspond in position to said leading end of said male terminal;

a cover overlaid from a rear side of said first connector housing;

a second connector housing;

a female terminal fitted in said second connector housing;

a simple clamp bolt passed through centers of said first and second connector housings so as to mate said first and second connector housings together by clamping;

a pair of housing indicators erected upright on an underside of said terminal protecting plate, said housing indicators being caused to stick out of said respective housing indicator holes when both said first and second connector housings are mated together; and sheaths provided on an inner wall of said cover opposite to said housing indicator hole, each of said sheaths having a cover indicator hole bored at a leading end thereof and containing a cover indicator.

6. A screw clamp type connector with a terminal protecting plate as claimed in claim 5, wherein said housing indicators are each provided with a temporary retaining protrusion for use in temporarily retaining said terminal protecting plate in said first connector housing, and wherein temporary retaining members corresponding in position to said respective temporary retaining protrusions are provided on said first connector housing.

7. A screw clamp type connector with a terminal protecting plate as claimed in claim 5, wherein said cover indicators are each provided with a projection at a fore-end thereof, and wherein a flexible piece is provided on both sides of said projection.

8. A screw clamp type connector with a terminal protecting plate as claimed in claim 7, wherein an indicator insertion opening for receiving said cover indicator is provided in a top of said sheath, and wherein tapered slopes are formed inside a lower portion of said sheath.

9. A screw clamp type connector with a terminal protecting plate, comprising:

a first connector housing having housing indicator holes;

a male terminal fitted in said first connector housing;

a terminal protecting plate fitted in said first connector housing for protecting a leading end of said male terminal, said terminal protecting plate having terminal support holes bored through a plane section of said terminal protecting plate in such a manner as to make said terminal support holes correspond in position to said leading end of said male terminal;

a cover overlaid from a rear side of said first connector housing;

a second connector housing;

a female terminal fitted in said second connector housing;

a simple clamp bolt passed through centers of said first and second connector housings so as to mate said first and second connector housings together by clamping;

indicator guides each having a cover indicator hole and provided on an inner wall of said cover opposite to said housing indicator holes; and a pair of housing indicators erected upright on an underside of said terminal protecting plate, said housing indicators being caused to stick out of said respective housing indicator holes when both said first and second connector housings are mated together, said housing indicators being long enough to stick out of said cover indicator holes when said cover is overlaid on said first connector housing.

10. A screw clamp type connector with a terminal protecting plate as claimed in claim 9, wherein said housing indicator is provided at both side end portions of said plane section of said terminal protecting plate.

11. A screw clamp type connector with a terminal protecting plate as claimed in claim 9 or 10, wherein said housing indicators and said plane section of said terminal protecting plate are formed integrally.

12. A screw clamp type connector with a terminal protecting plate as claimed in claim 9 or 10, wherein said housing indicators are each provided with a projection at a fore-end thereof, and wherein a flexible piece is provided on both sides of said projection.

13. A screw clamp type connector with a terminal protecting plate as claimed in claim 9 or 10, wherein said housing indicators are each provided with a temporary retaining protrusion for use in temporarily retaining said terminal protecting plate in said first connector housing, and wherein temporary retaining members corresponding in position to said respective temporary retaining protrusions are provided on said first connector housing.

14. A screw clamp type connector with a terminal protecting plate as claimed in claim 9 or 10, wherein an indicator insertion opening for receiving said housing indicator is provided in a top of said indicator guide, and wherein tapered slopes are formed inside a lower portion of said indicator guide.

* * * * *